US007183726B2

(12) United States Patent
Endo

(10) Patent No.: US 7,183,726 B2
(45) Date of Patent: Feb. 27, 2007

(54) COLD CATHODE FLUORESCENT LAMP DRIVE APPARATUS AND METHOD

(75) Inventor: Naoto Endo, Tama (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 56 days.

(21) Appl. No.: 11/064,721

(22) Filed: Feb. 24, 2005

(65) Prior Publication Data

US 2005/0264239 A1 Dec. 1, 2005

(30) Foreign Application Priority Data

May 27, 2004 (JP) ..... 2004-158230

(51) Int. Cl.
*G05F 1/00* (2006.01)

(52) U.S. Cl. ..... 315/291; 315/224; 315/272; 315/273

(58) Field of Classification Search ..... 315/224, 315/276, 279, 291, 307, 239, 245, 272, 273, 315/312
See application file for complete search history.

(56) References Cited

U.S. PATENT DOCUMENTS 5,886,477 A * 3/1999 Honbo et al. ..... 315/209 PZ
5,923,129 A * 7/1999 Henry ..... 315/307
6,259,615 B1 * 7/2001 Lin ..... 363/98
6,927,989 B2 * 8/2005 Fukumoto ..... 363/95
6,940,233 B2 * 9/2005 Gray ..... 315/276
6,954,364 B2 * 10/2005 Min ..... 363/56.08
6,969,956 B1 * 11/2005 Chou et al. ..... 315/209 PZ
6,979,957 B2 * 12/2005 Lee et al. ..... 315/195
2006/0038538 A1 * 2/2006 Inoue et al. ..... 320/157
2006/0038592 A1 * 2/2006 Inoue et al. ..... 327/108

FOREIGN PATENT DOCUMENTS

JP 03-112092 5/1991
JP 2002-141186 5/2002

* cited by examiner

*Primary Examiner*—Haissa Philogene
(74) *Attorney, Agent, or Firm*—Ladas & Parry LLP

(57) ABSTRACT

A cold cathode fluorescent lamp drive apparatus for lighting a cold cathode fluorescent lamp is disclosed. The cold cathode fluorescent lamp drive apparatus includes an abnormal current holding unit that is configured to hold an abnormal current that flows in the cold cathode fluorescent lamp, and a control unit that is configured to stop an operation of supplying a voltage to the fluorescent lamp according to the abnormal current held by the abnormal current holding unit.

7 Claims, 5 Drawing Sheets

COLD CATHODE FLUORESCENT LAMP DRIVE APPARATUS AND METHOD

BACKGROUND OF THE INVENTION

1. Field of the Invention

The present invention relates generally to a cold cathode fluorescent lamp drive apparatus and particularly to a cold cathode fluorescent lamp drive apparatus for lighting a cold cathode fluorescent lamp.

2. Description of the Related Art

In recent years and continuing, a liquid crystal display (LCD) panel is being widely used as a monitor of a television or a personal computer owing to its thin structure and low energy consumption. It is noted that the liquid crystal display panel itself is not provided with a light emitting function, and thereby, display is realized at the liquid crystal display panel by transmitting or reflecting natural light or light from a lighting system such as a backlight or a front light, for example. A cold cathode fluorescent lamp (CCFL) may be used in a lighting system for a liquid crystal display panel.

Owing to the characteristics of the cold cathode fluorescent lamp, a voltage of around a dozen hundred volts needs to be applied upon initially lighting the cold cathode fluorescent lamp, and a voltage of several hundred volts needs to be applied after lighting the cold cathode fluorescent lamp.

FIG. 1 is a block diagram showing a configuration of an exemplary lighting system using a cold cathode fluorescent lamp according to the prior art.

The lighting system 1 shown in FIG. 1 includes a cold cathode fluorescent lamp unit 11, a power source circuit 12, a current detection circuit 13, and a protection circuit 14.

In this system, a drive voltage from the power source circuit 12 is applied to the cold cathode fluorescent lamp unit 11. An input voltage Vin is applied to an input terminal Tin of the power source circuit 12. The power source circuit 12 is arranged to increase the input voltage Vin input to the input terminal Tin and apply the increased voltage to one end of the cold cathode fluorescent lamp unit 11.

The other end of the cold cathode fluorescent lamp unit 11 is grounded via the detection circuit 13. The detection circuit 13 converts a current flowing in the cold cathode fluorescent lamp unit 11 into a voltage and supplies the converted voltage to the protection circuit 14.

The protection circuit 14 includes a current control circuit 21, a lighting failure detection circuit 22, and a forced shutdown circuit 23.

The voltage converted by the current detection circuit 13 according to the current flowing in the cold cathode fluorescent lamp unit 11 is supplied to the current control circuit 21. The current control circuit 21 is arranged to control the voltage being applied to the cold cathode fluorescent lamp unit 11 from the power source circuit 12 according to the voltage supplied from the current detection circuit 13 so that the current flowing in the cold cathode fluorescent lamp unit 11 may be maintained at a fixed level.

The voltage converted by the current detection circuit 13 according to the current flowing in the cold cathode fluorescent lamp unit 11 is also supplied to the lighting failure detection circuit 22. The lighting failure detection circuit 22 is arranged to detect a lighting failure of the cold cathode fluorescent lamp unit 11 according to the voltage supplied from the detection circuit 13. A detection signal generated at the lighting failure detection circuit 22 is supplied to the forced shutdown circuit 23. When the detection signal from the lighting failure detection circuit 22 indicates a lighting failure detection state, the forced shutdown circuit 23 temporarily shuts down the operation of the power source circuit 12.

In Japanese Laid-Open Patent Publication No. 3-112092, technology is disclosed for improving the response speed of a protective function of a fluorescent lamp lighting system for protecting a fluorescent lamp used therein by providing a detection circuit that is arranged to detect a current flowing in the fluorescent lamp to detect an abnormality of the fluorescent lamp.

In Japanese Laid-Open Patent Publication No. 2002-141186, technology is disclosed for protecting a fluorescent lamp used in a fluorescent lamp lighting system by providing a detection circuit that detects a current flowing in the fluorescent lamp to detect an abnormality of the fluorescent lamp and shuts down the operation of a power source circuit that supplies a power voltage to the fluorescent lamp when an abnormality is detected.

It is noted that the cold cathode fluorescent lamp unit 11 is connected to the power source circuit 12 and the current detection circuit 13 via connectors CN. When a small gap is formed at a connection point due to malconnection of the connector CN, electrical discharge such as arcing may occur. In this case, the electrical discharge caused by the malconnection of the connector CN may continually occur from vibration, for example, unless measures are taken to fix the connection of the connector CN.

In the cold cathode fluorescent lamp drive system according to the prior art, a current flowing in cold cathode fluorescent lamp unit 11 is detected in order to detect an abnormality of the cold cathode fluorescent lamp unit 11, and the protective function of the system is operated only when an abnormality is detected. Thereby, even when electrical discharge such as arcing occurs from receiving a high voltage due to malconnection of the connector CN, when a connection state is reestablished, the protective action may be lifted, and a high voltage may be applied to the fluorescent lamp once more to cause the occurrence of the electrical discharge. That is, the system may be continually used even in an abnormal state, and thereby, problems may occur with respect to stability and reliability of the system operation.

SUMMARY OF THE INVENTION

The present invention has been conceived in response to one or more of the problems of the related art, and its object is to provide a cold cathode fluorescent lamp drive apparatus that is capable of providing protection against malconnection of the cold cathode fluorescent lamp with a simple structure.

According to an aspect of the present invention, a cold cathode fluorescent lamp drive apparatus that lights a cold cathode fluorescent lamp is provided, the apparatus including:

an abnormal current holding unit that is configured to hold an abnormal current that flows in the cold cathode fluorescent lamp; and a control unit that is configured to stop an operation of supplying a voltage to the fluorescent lamp according to the abnormal current held by the abnormal current holding unit.

According to a preferred embodiment of the present invention, the abnormal current holding unit corresponds to a peak hold circuit.

According to another preferred embodiment of the present invention, the abnormal current holding unit includes a capacitor that is charged by the abnormal current; and when the abnormal current occurs a predetermined number of times, the charge of the capacitor reaches a predetermined voltage that induces the control unit to stop the operation of supplying a voltage to the cold cathode fluorescent lamp.

According to another preferred embodiment of the present invention, the cold cathode fluorescent lamp drive apparatus further includes a lighting failure detection unit that is configured to detect a lighting failure of the cold cathode fluorescent lamp; and the control unit includes a shutdown circuit that is configured to stop the operation of supplying a voltage to the cold cathode fluorescent lamp according to at least one of the lighting failure detection and the abnormal current held by the abnormal current holding unit.

According to another aspect of the present invention, a method of driving a cold cathode fluorescent lamp is provided, the method including the steps of:

holding an abnormal current that flows in the fluorescent lamp; and stopping an operation of supplying a voltage to the fluorescent lamp according to the held abnormal current.

According to a preferred embodiment, the method of the present invention further includes the steps of charging a capacitor with the abnormal current; and stopping the operation of supplying a voltage to the fluorescent lamp when the charge of the capacitor reaches a predetermined voltage in response to a predetermined number of occurrences of the abnormal current.

According to another preferred embodiment, the method of the present invention further includes the steps of detecting a lighting failure of the cold cathode fluorescent lamp, and stopping the operation of supplying a voltage to the cold cathode fluorescent lamp according to at least one of the lighting failure detection and the abnormal current.

DETAILED DESCRIPTION OF THE PREFERRED EMBODIMENTS

In the following, principles and embodiments of the present invention will be described with reference to the accompanying drawings.

Figure 1:
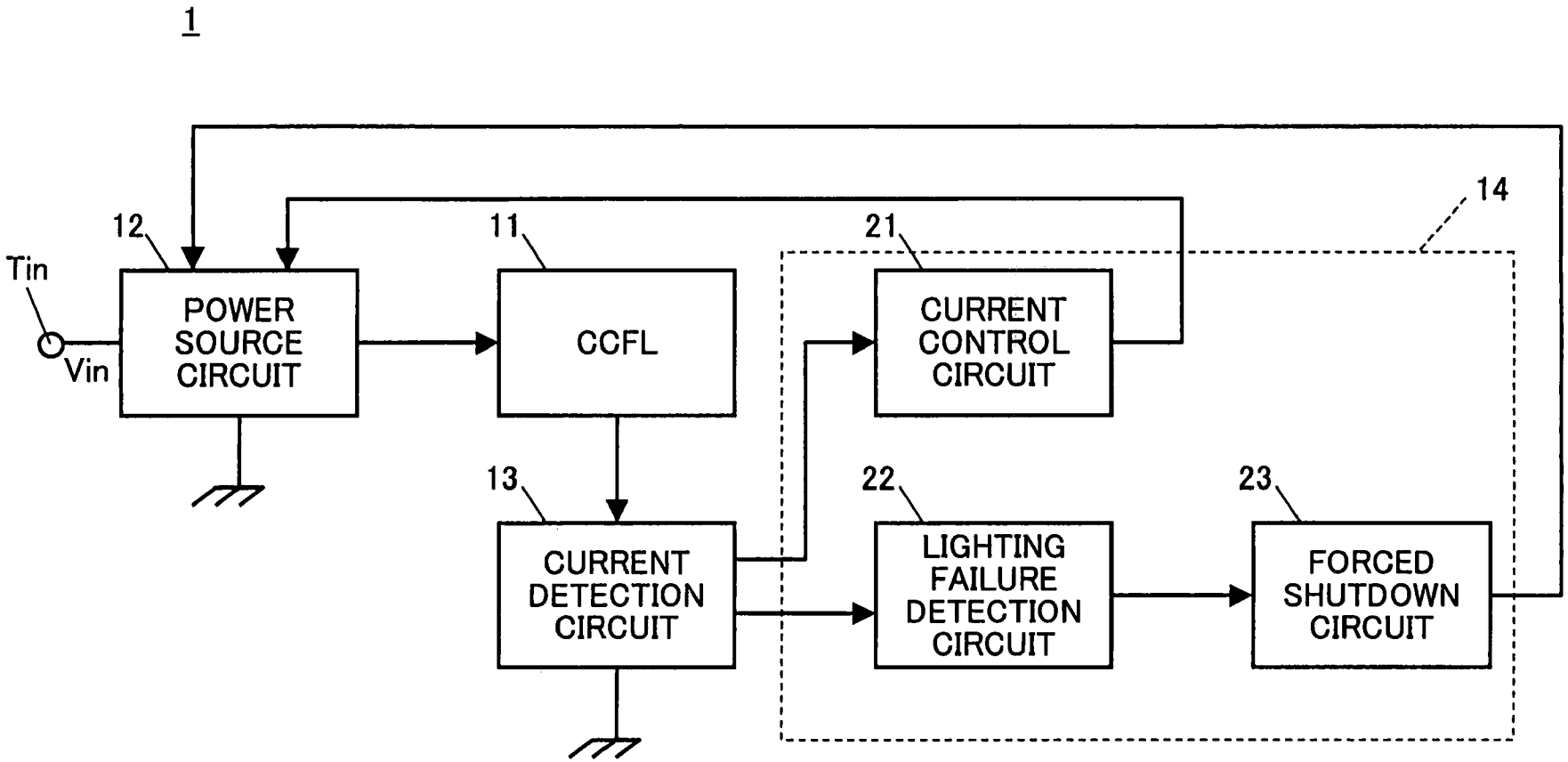
FIG.1 PRIOR ART
FIG. 1 is a block diagram showing a configuration of a lighting system according to the prior art.
Figure 2:
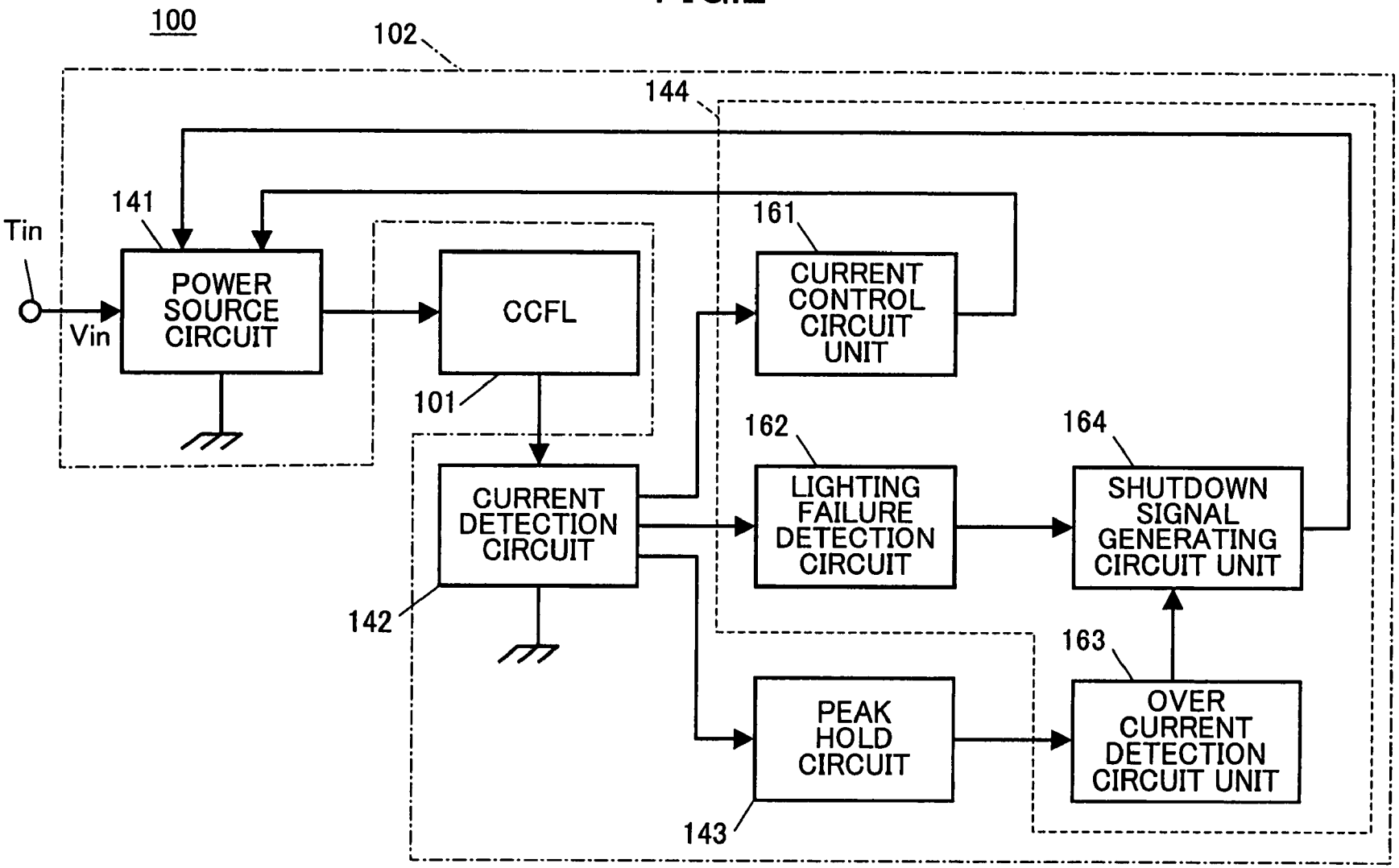
FIG. 2 is a block diagram showing a configuration of a lighting system according to an embodiment of the present invention.
Figure 3:
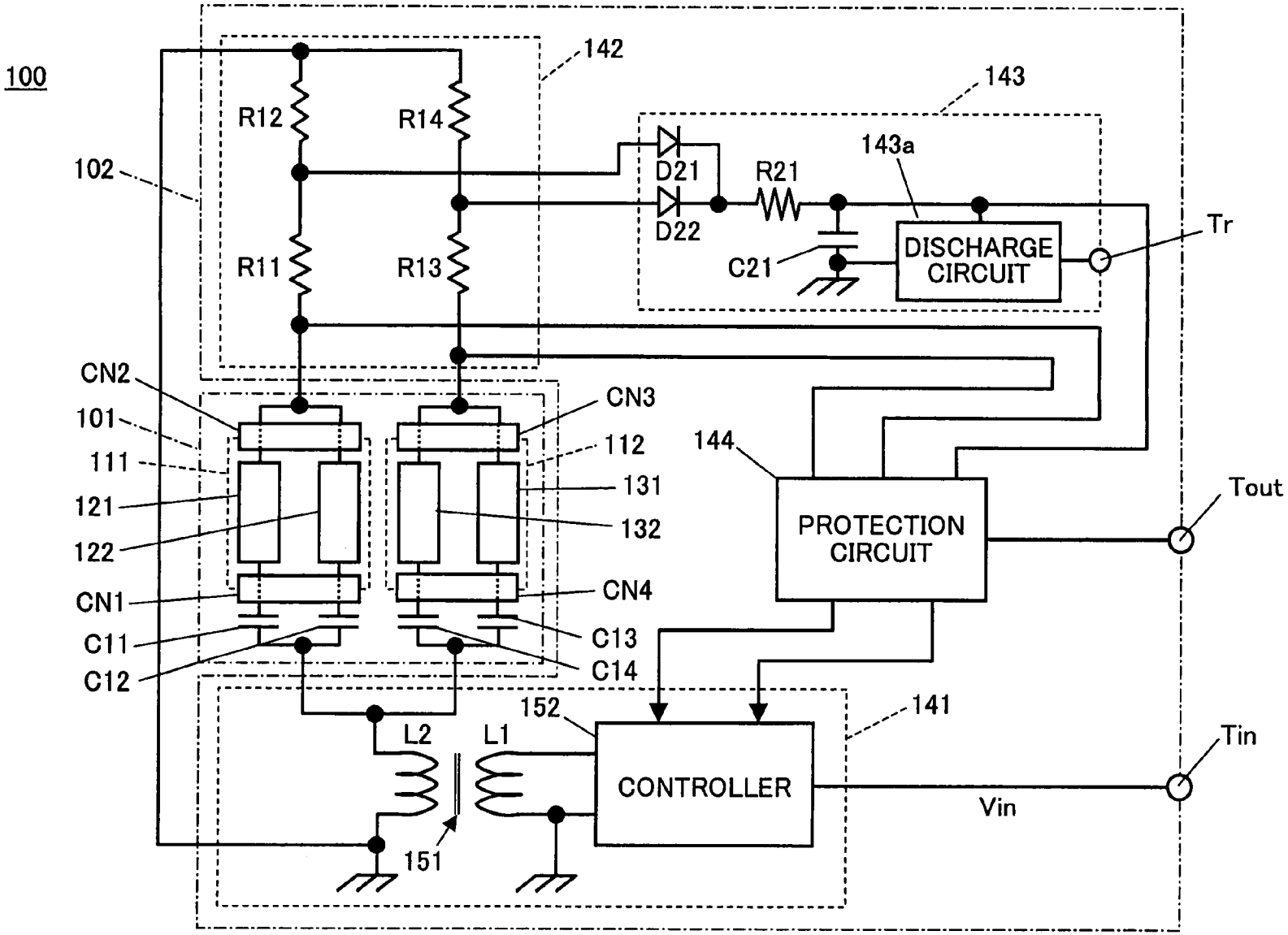
FIG. 3 is a diagram showing a circuit structure of the lighting system according to the present embodiment.

FIG. 2 is a block diagram showing a configuration of a lighting system according to an embodiment of the present invention. FIG. 3 is a diagram showing a circuit sturcture of the lighting system according to the present embodiment.

The lighting system 100 shown in FIGS. 2 and 3 includes a cold cathode fluorescent lamp unit 101 and a cold cathode fluorescent lamp drive apparatus 102 that drives the cold cathode fluorescent lamp unit 101.

Referring to FIG. 3, the cold cathode fluorescent lamp unit 101 includes a first cold cathode fluorescent lamp pair 111 and a second cold cathode fluorescent lamp pair 112. The first cold cathode fluorescent lamp pair 111 includes a cold cathode fluorescent lamp 121 and a cold cathode fluorescent lamp 122 that are arranged to be parallel. The second cold cathode fluorescent lamp pair 112 includes a cold cathode fluorescent lamp 131 and a cold cathode fluorescent lamp 132 that are arranged to be parallel.

It is noted that one end of the cold cathode fluorescent lamp 121 is connected to a capacitor C11 via a connector CN1, and the other end of the cold cathode fluorescent lamp 121 is connected to a resistor R11 via a connector CN2. One end of the cold cathode fluorescent lamp 122 is connected to a capacitor C12 via the connector CN1 and the other end of the cold cathode fluorescent lamp 122 is connected to the resistor R11 via the connector CN2.

One end of the cold cathode fluorescent lamp 131 is connected to a capacitor C13 via a connector CN4, and the other end of the cold cathode fluorescent lamp 131 is connected to a resistor R13 via a connector CN3. One end of the cold cathode fluorescent lamp 132 is connected to a capacitor C14 via the connector CN4, and the other end of the cold cathode fluorescent lamp 132 is connected to the resistor R13 via the connector CN3.

According to the illustrated example, the cold cathode fluorescent lamp drive apparatus 102 includes a power source circuit 141, a current detection circuit 142, a peak hold circuit 143, and a protection circuit 144.

The power source circuit 141 includes a transformer 151 and a controller 152. The controller 152 includes an input terminal Tin from which an input voltage Vin is supplied.

The controller 152 is arranged to switch the input voltage Vin into an electric current and apply the switched current to a first coil L1 of the transformer 151. In this way, an electric current may be supplied to the first coil L1. The transformer 151 is arranged to induce a current in a second coil L2 according to the current flowing in the first coil L1 so that a voltage may be generated at the second coil L2. The voltage generated at the second coil L2 may be applied to the connector CN1 via the capacitors C11 and C12 as well as the connector CN4 via the capacitors C13 and C14.

The detection circuit 142 includes the resistors R11–R14. The resistors R11 and R12 are serially connected to each other. One end of the serial circuit formed by the resistors R11 and R12 is connected to the cold cathode fluorescent lamp 121 and the cold cathode fluorescent lamp 122 of the first cold cathode fluorescent lamp pair 111 via the connector CN2. The other end of the serial circuit formed by the resistors R11 and R12 is grounded.

The resistors R13 and R14 are serially connected to each other. One end of the serial circuit formed by the resistors R13 and R14 is connected to the cold cathode fluorescent lamp 131 and the cold cathode fluorescent lamp 132 of the second cold cathode fluorescent lamp pair 112 via the connector CN3. The other end of the serial circuit formed by the resistors R13 and R14 is grounded.

The connection point between the connector CN2 and the resistor R11 and the connection point between the connector CN3 and the resistor R13 are connected to the protection circuit 144. The connection point between the resistors R11 and R12 and the connection point between the resistors R13 and R14 are connected to the peak hold circuit 143.

The peak hold circuit 143 includes diodes D21 and D22, a resistor R21, a capacitor C21, and a discharge circuit 143*a*.

The anode of the diode D21 is connected to the connection point between the resistors R11 and R12, and the cathode of the diode D21 is connected to one end of the capacitor C21 via the resistor R21.

For example, when electrical discharge such as arcing occurs at a gap formed at the high potential connector CN1 due to malconnection of the connector CN1, the potential at the connection point between the resistors R11 and R12 abruptly increases. When the voltage at the connection point between the resistors R11 and R12 increases to reach a voltage that is greater than a predetermined voltage V11, the diode D21 is turned on. When the diode D21 is turned on, an electrical charge is supplied to the capacitor C21 via the resistor R21.

For example, when electrical discharging such as arcing occurs at a gap formed at the high potential connector CN4 due to malconnection of the connector CN4, the potential at the connection point between the resistors R13 and R14 abruptly increases. When the voltage at the connection point between the resistors R13 and R14 increases to reach a voltage that is greater than a predetermined voltage V11, the diode D22 is turned on. When the diode D12 is turned on, an electrical charge is supplied to the capacitor C21 via the resistor R21.

The predetermined voltage V11 may be set according to the forward voltage Vf of the diodes D21 and 22 and the resistor R21. By setting the predetermined voltage V11 for turning on the diodes D21 and D22 to a sufficiently high voltage, the capacitor C21 may be charged only when malconnection occurs at one or both of the connectors CN1 and CN4. In other words, the capacitor C21 may be charged only when electric discharging such as arcing occurs. The electrical potential at the capacitor C21 may be supplied to the protection circuit 144.

The discharge circuit 143*a* is arranged to discharge the electrical charge of the capacitor C21 according to a reset signal input from a reset terminal Tr.

Referring to FIG. 2, the protection circuit 144 includes a current control circuit unit 161, a lighting failure detection circuit unit 162, an overcurrent detection circuit unit 163, and a shutdown signal generating circuit unit 164.

Figure 4:
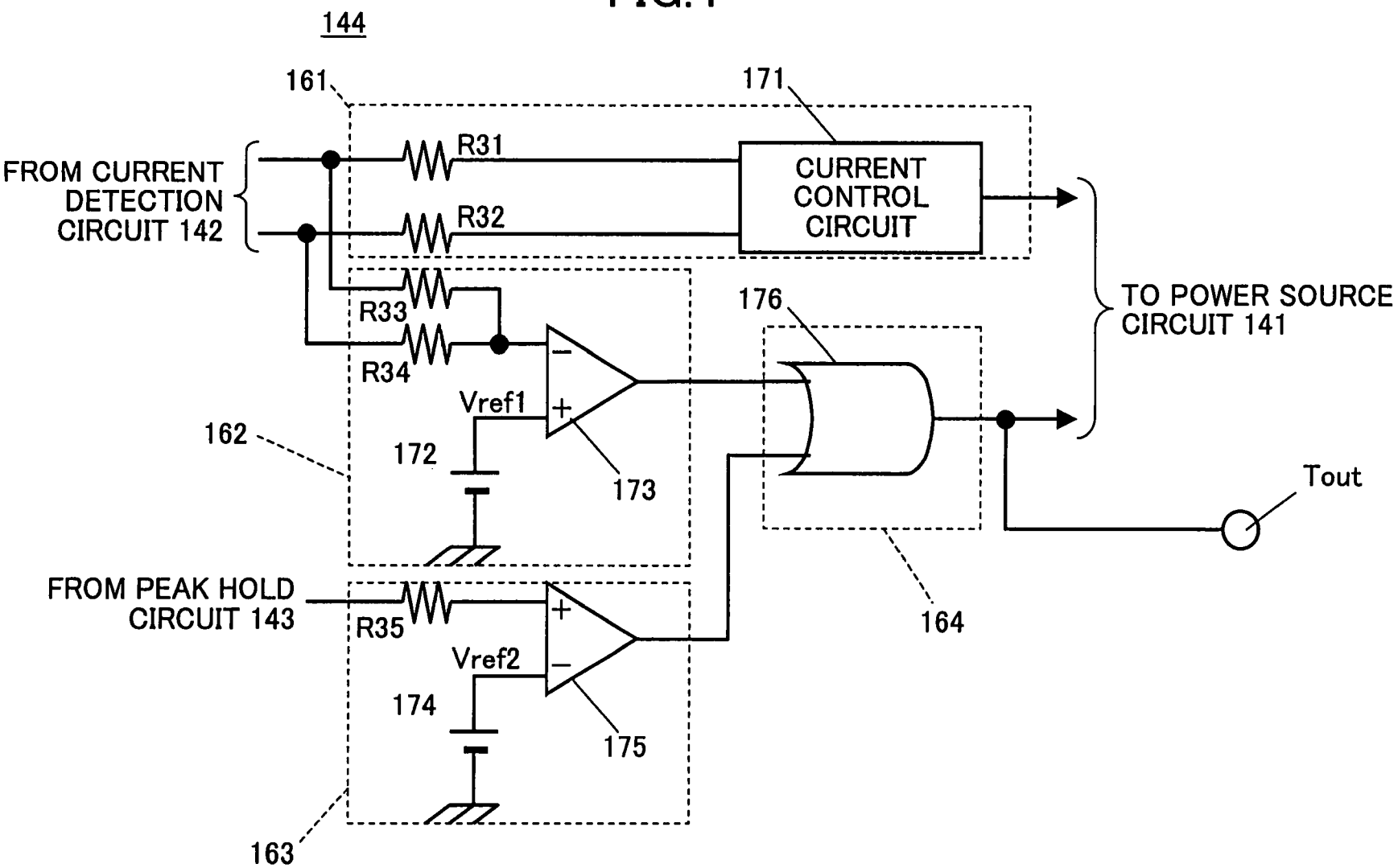
FIG. 4 is a diagram showing a detailed configuration of a protection circuit of the lighting system of the present embodiment.

The current control circuit unit 161 includes resistors R31 and R32, and a current control circuit 171 (FIG. 4). Voltages of the connectors CN2 and CN3 are supplied to the current control circuit 171 via the resistors R31 and R32. The current control circuit 171 generates a control signal for controlling the power source circuit 141 to maintain the voltages of the connectors CN2 and CN3 at a fixed level. The control signal generated at the current control circuit 171 is supplied to the controller 152 of the power source circuit 141. The controller 152 may control the period, the pulse width, and/or the voltage level of the voltage applied to the first coil L1, for example, according to the control signal from the current control circuit 171. In this way, the voltage applied to the cold cathode fluorescent lamp unit 101 may be controlled.

FIG. 4 is a diagram showing a detailed configuration of the protection circuit 144.

According to FIG. 4, the lighting failure detection circuit unit 162 of the protection circuit 144 includes resistors R33 and R34, a reference voltage source 172, and a comparator 173. It is noted that a reference voltage Vref1 from the reference voltage source 172 is applied to a noninverting terminal of the comparator 173. An electric potential of the connectors CN3 and CN4 is applied to an inverting terminal of the comparator 173 via the resistors R33 and R34, respectively. The comparator 173 is arranged to output a high-level voltage when all of the cold cathode fluorescent lamps 121, 122, 131, and 132 are turned off, and the electric potential of the connectors CN2 and/or CN3 is less than the reference voltage Vref1. The output of the comparator 173 is supplied to the shutdown signal generating circuit unit 164.

It is noted that according to the present example, the lighting failure detection circuit 162 is arranged to output a high-level voltage when all the cold cathode fluorescent lamps 121, 122, 131, and 132 are turned off to detect a lighting failure. However, the present invention is not limited to such an example, and alternative embodiments are possible in which the lighting failure detection circuit 162 is arranged to output a high-level voltage when lighting failure of at least one of the cold cathode fluorescent lamps 121, 122, 131, and 132 is detected.

According to the present example, the overcurrent detection circuit 163 includes a resistor 35, a reference voltage source 174, and a comparator 175.

It is noted that a reference voltage Vref2 from the reference voltage source 174 is applied to an inverting terminal of the comparator 175. Also, a voltage of the capacitor C21 of the peak hold circuit 143 is applied to a noninverting terminal of the comparator 175 via the resistor R35. The comparator 175 is arranged to output a high-level voltage when the charged voltage of the capacitor C21 exceeds the reference voltage Vref2 as a result of the repetitive upsurge of the electric potential at the connection point between the resistors R11 and R12 and/or the connection point between the resistors R13 and R14 due to electrical discharge such as arcing occurring at the gap formed at the connectors CN1 and CN4. The output of the comparator 175 is supplied to the shutdown signal generating circuit unit 164.

The shutdown signal generating circuit unit 164 includes an OR gate 176, for example. It is noted that the output of the comparator 173 of the lighting failure detection circuit 162 and the output of the comparator 175 of the overcurrent detection circuit 163 are supplied to the OR gate 176. The OR gate 176 is arranged to output a logical addition (OR) of the outputs of the comparators 173 and 175.

The output of the OR gate 176 is set to a high level upon shutting down the power source circuit 141, and the output of the OR gate 176 is set to a low level upon maintaining an operating state of the power source circuit 141. The output of the OR gate 176 is supplied to the controller 152 of the power source circuit 141. The power source circuit 141 is arranged to set a voltage to be applied to the first coil L1 of the transformer 151 to zero when the output from the OR gate 176 corresponds to a high-level output, and set the voltage to be applied to the first coil L1 of the transformer 151 to have a period, pulse width, or voltage level according to the control signal from the current control circuit unit 161 when the output from the OR gate 176 corresponds to a low-level output.

It is noted that the output of the OR gate 176 is output to the exterior via a terminal Tout. By determining the state of the terminal Tout, a lighting failure or a malconnection of the high potential connectors CN1 and CN4 may be detected. In this way, maintenance of the cold cathode fluorescent lamp may be easily realized.

Figure 5:
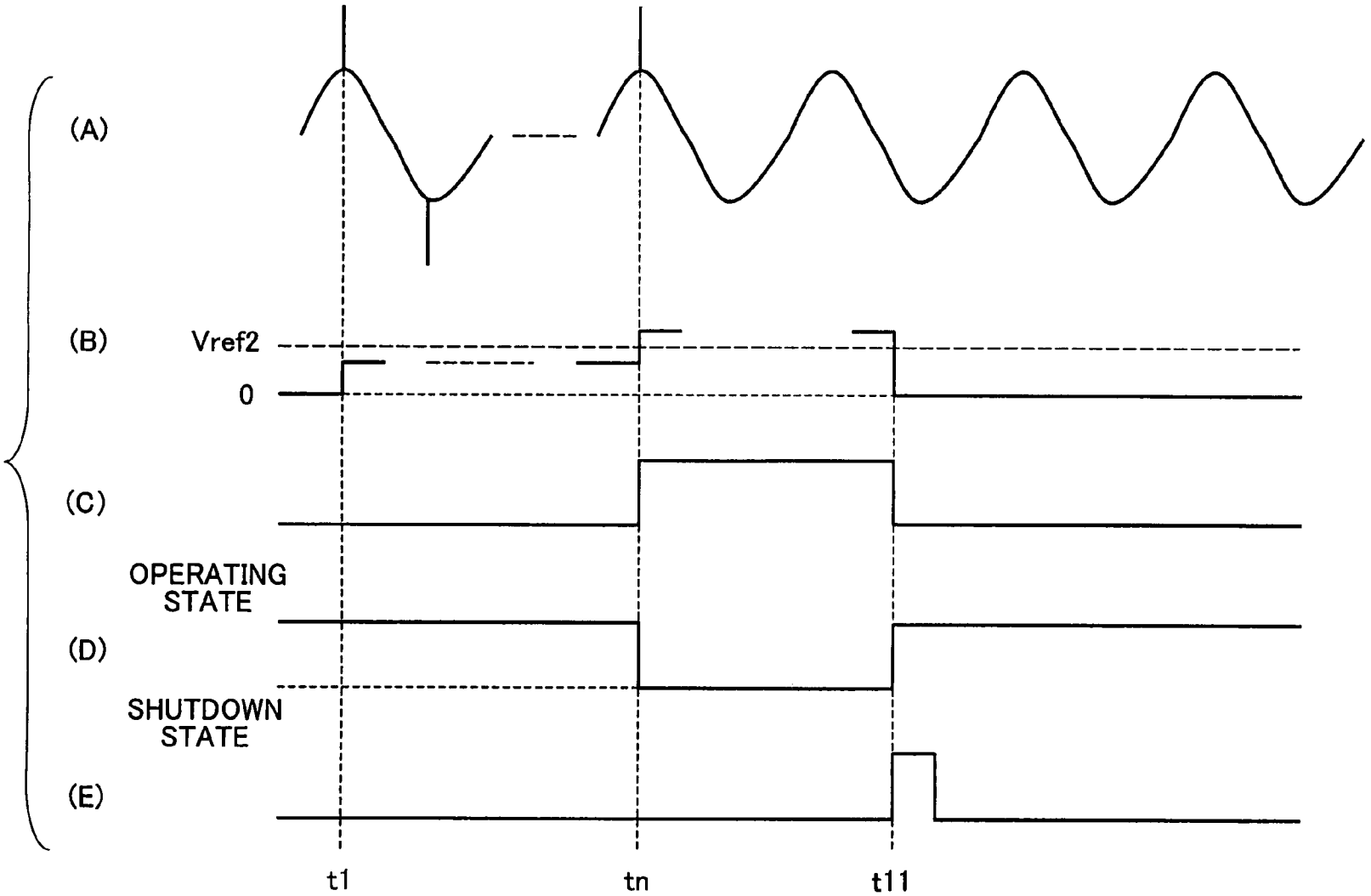
FIG. 5 is a timing diagram illustrating an exemplary operation of the lighting system of the present embodiment.

FIG. 5 is a diagram illustrating an exemplary operation of the lighting system 100 according to an embodiment of the present invention. In FIG. 5, (A) illustrates a voltage of the connection point between the resistors R11 and R12 or the connection point between the resistors R13 and R14; (B) illustrates the charge voltage of the capacitor C21; (C) illustrates the output of the OR gate 176; (D) illustrates the operating state of the power source circuit 141; and (E) illustrates the state of the reset terminal Tr.

According to the illustrated example, when electrical discharge such as arcing occurs due to malconnection of the high potential connectors CN1 and CN4 during time t1~tn as is shown in FIG. 5 (A) and the diodes D21 and D22 are turned on, the capacitor C21 is gradually charged as is shown in FIG. 5 (B). When the upsurge of the electric potential at the connection point between the resistors R11 and R12 or the connection point between the resistors R13 and R14 due to malconnection of the connectors CN1 and CN4 repeatedly occurs n times, and the charged voltage of the capacitor C21 reaches the reference voltage Vref2 at time tn, the output of the overcurrent detection circuit 163 is set to a high level.

When the output of the overcurrent detection circuit 163 is set to a high level, the output of the OR gate 176 is set to a high level as is shown in FIG. 5 (C). In turn, the operation of the power source circuit 141 is stopped as is shown in FIG. 5 (D), and thereby, the operation of supplying a voltage from the power source circuit 141 to the connectors CN1 and CN4 of the cold cathode fluorescent lamp unit 101 is stopped. In turn, the voltage at the connection point between the resistors R11 and R12 or the connection point between the resistors R13 and R14 is set to zero potential as is shown in FIG. 5 (A).

According to the present example, the charge voltage of the capacitor C12 is held so that the shutdown state of the operation for supplying a voltage from the power source circuit 141 to the connectors CN1 and CN4 of the cold cathode fluorescent lamp unit 101 is maintained until a reset signal is supplied to the reset terminal Tr of the peak hold circuit 143 at time t11 as is shown in FIG. 5 (E). When the reset signal is supplied to the reset terminal Tr of the peak hold circuit 143 at time t11 as is shown in FIG. 5 (E), a voltage is generated once again at the connection point between the resistors R11 and R12 or the connection point between the resistors R13 and R14 as is shown in FIG. 5 (A).

According to the present embodiment, accurate protection may be provided against malconnection of a cold cathode fluorescent lamp in a lighting system using a simple structure.

It is noted that in the present embodiment, the peak hold circuit 143 is used as an abnormal current holding unit, and the power source circuit 141 and the protection circuit are used as a control unit for stopping the operation of supplying a voltage to a cold cathode fluorescent lamp. However, such an embodiment merely illustrates an example, and alternative embodiments may be conceived within the scope of the present invention.

It is noted also that, in the present embodiment, two pairs cathode fluorescent lamps are used. However, such an embodiment is merely illustrated as an example, and any number of cathode fluorescent lamps may be used.

Further, the present invention is not limited to the specific embodiments described above, and variations and modifications may be made without departing from the scope of the present invention.

The present application is based on and claims the benefit of the earlier filing date of Japanese Patent Application No. 2004-158230 filed on May 27, 2004, the entire contents of which are hereby incorporated by reference.

What is claimed is:

1. A cold cathode fluorescent lamp drive apparatus that lights a cold cathode fluorescent lamp, the apparatus comprising:

an abnormal current holding unit that is configured to hold an abnormal current that flows in the cold cathode fluorescent lamp for detecting at least abnormal electric discharge including arcing; and a control unit that is configured to stop an operation of supplying a voltage to the cold cathode fluorescent lamp according to the abnormal current held by the abnormal current holding unit.

2. The cold cathode fluorescent lamp drive apparatus as claimed in claim 1, wherein the abnormal current holding unit corresponds to a peak hold circuit.

3. The cold cathode fluorescent lamp drive apparatus as claimed in claim 1, wherein the abnormal current holding unit includes a capacitor that is charged by the abnormal current; and when the abnormal current occurs a predetermined number of times, the charge of the capacitor reaches a predetermined voltage that induces the control unit to stop the operation of supplying a voltage to the cold cathode fluorescent lamp.

4. The cold cathode fluorescent lamp drive apparatus as claimed in claim 1, further comprising:

a lighting failure detection unit that is configured to detect a lighting failure of the cold cathode fluorescent lamp;

wherein the control unit includes a shutdown circuit that is configured to stop the operation of supplying a voltage to the cold cathode fluorescent lamp according to at least one of the lighting failure detection and the abnormal current held by the abnormal current holding unit.

5. A method of driving a cold cathode fluorescent lamp, the method comprising the steps of:

holding an abnormal current that flows in the cold cathode fluorescent lamp for detecting at least abnormal electric discharge including arcing; and stopping an operation of supplying a voltage to the cold cathode fluorescent lamp according to the held abnormal current.

6. The method of driving a cold cathode fluorescent lamp as claimed in claim 5, further comprising the steps at charging a capacitor with the abnormal current; and stopping the operation of supplying a voltage to the cold cathode fluorescent lamp when the charge of the capacitor reaches a predetermined voltage in response to a predetermined number of occurrences of the abnormal current.

7. The method of driving a cold cathode fluorescent lamp as claimed in claim 5, further comprising the steps of:

detecting a lighting failure of the cold cathode fluorescent lamp; and stopping the operation of supplying a voltage to the cold cathode fluorescent lamp according to at least one of the lighting failure detection and the abnormal current.

* * * * *